United States Patent [19]

Hohman

[11] Patent Number: 4,550,574

[45] Date of Patent: Nov. 5, 1985

[54] REFRIGERATION SYSTEM WITH LIQUID BYPASS LINE

[75] Inventor: John E. Hohman, Evart, Mich.

[73] Assignee: Sexton-Espec, Inc., Zeeland, Mich.

[21] Appl. No.: 663,033

[22] Filed: Oct. 19, 1984

Related U.S. Application Data

[63] Continuation-in-part of Ser. No. 500,266, Jun. 2, 1983, abandoned.

[51] Int. Cl.[4] ..... F25B 41/00

[52] U.S. Cl. ..... 62/197; 62/196.3

[58] Field of Search ..... 62/197, 216, 199, 200, 62/204, 205, 196.3

[56] References Cited

U.S. PATENT DOCUMENTS

| | | | |
|---|---|---|---|
| 2,739,451 | 3/1956 | Breck | 62/204 |
| 3,243,970 | 4/1966 | Lippincott | 62/197 |
| 3,313,121 | 4/1967 | Barbier | 62/197 |
| 3,369,374 | 2/1968 | Miller | 62/197 |
| 3,477,240 | 11/1969 | Thoren et al. | 62/197 X |
| 3,590,595 | 7/1971 | Briggs | 62/197 |
| 3,677,028 | 7/1972 | Raymond | 62/200 |
| 4,230,470 | 10/1980 | Matsuda et al. | 62/197 |
| 4,258,553 | 3/1981 | Kelly et al. | 62/197 X |
| 4,446,704 | 5/1984 | Yamazaki et al. | 62/196.3 |

FOREIGN PATENT DOCUMENTS

| | | | |
|---|---|---|---|
| 1314341 | 4/1973 | United Kingdom | 62/199 |

*Primary Examiner*—Harry Tanner

*Attorney, Agent, or Firm*—Varnum, Riddering, Schmidt & Howlett

[57] ABSTRACT

A cascade refrigeration system includes an evaporator unit (10, 12) located adjacent a test chamber and remote from the refrigeration system. A conduit (38) carries refrigerant from the cascade refrigeration system to the evaporator unit (10, 12). The liquid refrigerant passed through an expansion valve (28) to meter the refrigerant to delivery to the evaporator unit (10, 12). Spent refrigerant exiting the evaporator unit is returned to the cascade refrigeration system by a return line (40). In order to maintain a constant liquid refrigerant flow to the expansion valve so as to enable the refrigeration system to cool the chamber as needed, liquid refrigerant is bypassed around the evaporator unit (10, 12) and to the return line (40). The bypass circuit includes a control valve (162) which selectively diverts liquid refrigerant to the return line (40) during low-demand conditions at the evaporator unit (10, 12), thus maintaining a constant supply of liquid at the expansion valve.

8 Claims, 1 Drawing Figure

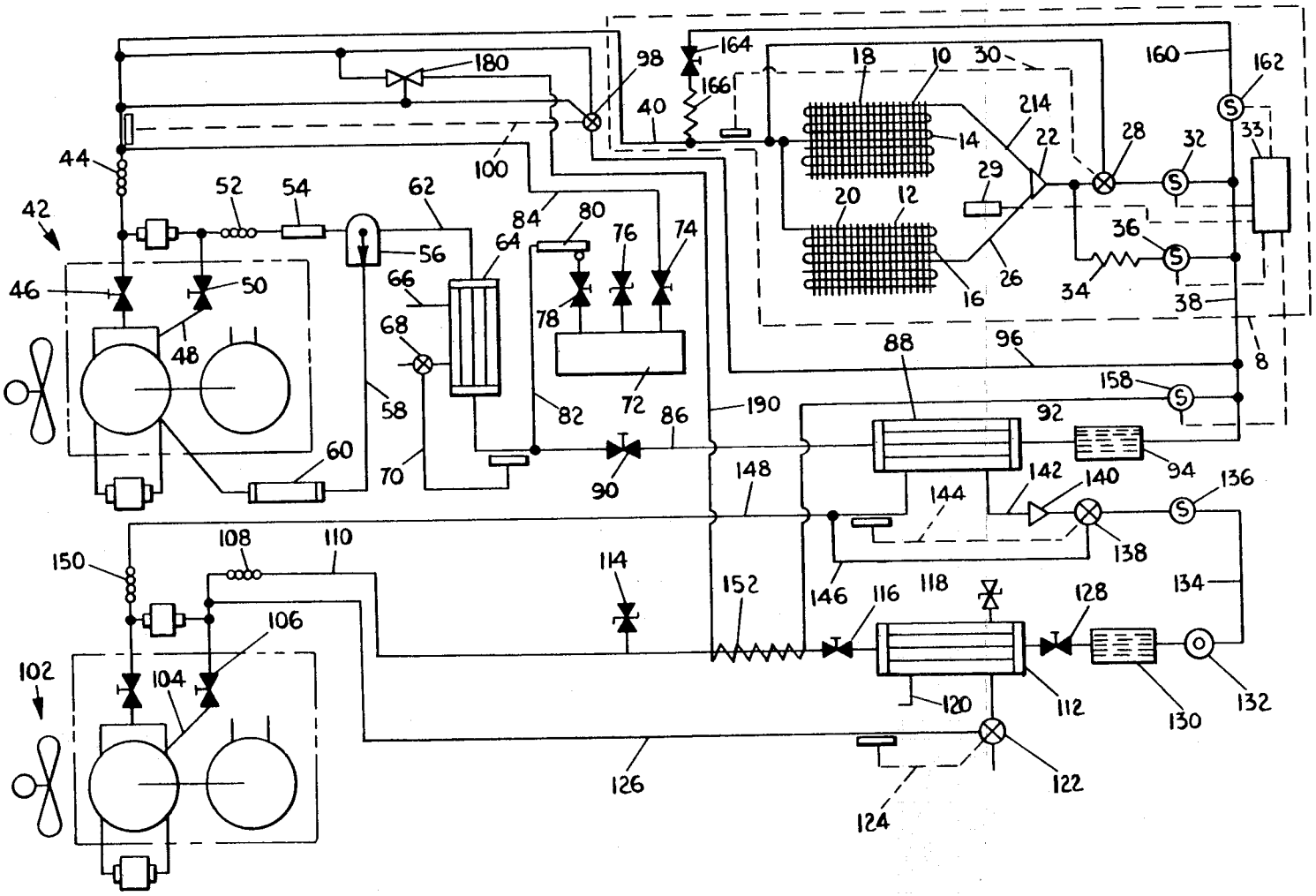
8
10
12
14
16
18
20
22
26
28
29
30
32
33
34
36
38
40
42
44
46
48
50
52
54
56
58
60
62
64
66
68
70
72
74
76
78
80
82
84
86
88
90
92
94
96
98
100
102
104
106
108
110
112
114
116
118
120
122
124
126
128
130
132
134
136
138
140
142
144
146
148
150
152
158
160
162
164
166
180
190
214

REFRIGERATION SYSTEM WITH LIQUID BYPASS LINE

CROSS-REFERENCE TO RELATED APPLICATION

This application is a continuation-in-part of U.S. patent application Ser. No. 06/500,266 filed June 2, 1983, entitled Refrigeration System With Liquid Bypass Line now abandoned.

Technical Field

This invention relates to a refrigeration system for a test chamber.

BACKGROUND INFORMATION

Cascade refrigeration systems are conventionally used to regulate the temperature in test chambers which form a part of environmental testing apparatus. In such cascade refrigeration systems, evaporator coils mounted in the test chamber are provided with a cooled refrigerant so as to remove heat from the chamber and thus lower the chamber temperature. The cooled refrigerant is supplied to the evaporator coils by a conventional compressor-condenser system. The refrigerant used in this system is continuously cycled in a vapor-compression refrigeration cycle.

In the cascade refrigeration system, a secondstage system including a compressor-condenser cools a refrigerant which is then passed in a heat-exchange relationship with the refrigerant of the first stage so as to lower the temperature of the first refrigerant before delivery to the evaporator coils of the chamber. This type of cascade refrigeration system is well known and conventional in environmental test chambers.

One such example of a test chamber including a cascade refrigeration system is shown in U.S. Pat. No. 3,590,595 issued July 6, 1971. The refrigeration system shown in the above-referenced patent includes a conventional cascade refrigeration system which is further equipped with a bypass system for removing refrigerant before it is delivered to the evaporator and delivering this refrigerant to the outlet side of the evaporator so as to provide for a liquid flow to the expansion valve at low-load conditions.

The apparatus shown in the '595 patent includes a bypass circuit in the form of a line which diverts refrigerant through a solenoid to an expansion valve. The expansion valve then supplies the cooled refrigerant to a bypass heat exchanger, which refrigerant is then supplied to the input of the first-stage compressor. The return of the heat exchanger is communicated to the outlet side of the evaporator. This bypass circuit is utilized during periods when the refrigeration requirements at the test chamber are reduced.

The above-described system is useful when piping refrigeration to remote units. However, this device does require the addition of a third pipe for bypassing refrigerant to the outlet side of the evaporator.

DISCLOSURE OF THE INVENTION

In order to provide for a constant delivery of cooled refrigerant to the expansion valve upstream of the evaporator unit, a refrigeration system is provided with a first bypass conduit which diverts liquid refrigerant around the evaporator unit and to the return line of the evaporator unit at the evaporator unit. A second bypass conduit diverts liquid refrigerant around a compressor and cooling system at the compressor and cooling system. In this way, a constant flow of liquid refrigerant is maintained to the expansion valve which allows the refrigeration system to cool the test chamber as needed. The refrigeration system includes a conventional refrigeration system having an evaporator which cools a test chamber. The evaporator is located adjacent the chamber and remote from the compressor and cooling system. The refrigerant is communicated to the evaporator by a conduit which connects the evaporator unit to the refrigeration system. The refrigerant is cooled and expanded in a conventional expansion valve disposed between the evaporator unit and the compressor and cooling system. Spent refrigerant exiting the evaporator unit is returned to the compressor and cooling system by a return line.

The bypass conduit can include control valves which selectively divert refrigerant to the return line in both bypass conduits during low-demand conditions at the evaporator unit. In this way, a constant liquid refrigerant flow to the expansion valve is provided which avoids stagnation and formation of vapor at the expansion valve. Desirably, the first bypass line has a restrictor valve which limits the flow of refrigerant therethrough to a trickle to minimize the flow of refrigerant through the long refrigerant supply conduit.

BRIEF DESCRIPTION OF THE DRAWING

The invention will be described with reference to the sole figure which is a schematic diagram of a refrigeration system in accordance with the invention.

BEST MODE FOR CARRYING OUT THE INVENTION

With reference to the sole figure, a refrigeration system for an environmental test chamber is shown. The system includes a chamber in which materials to be tested are placed. The temperature within the chamber is controlled by the refrigeration system to be described herein. The apparatus at the test chamber is indicated by the dotted line 8.

The refrigeration system in accordance with the invention cools the test chamber by means of evaporator coils 10 and 12. The evaporator coils 10 and 12 each include a plurality of passes 14, 16 of a tube which carries a refrigerant. The coils 10 and 12 are provided with a number of heat-transfer fins 18 and 20 which increase the size of the heat-exchange surface so as to increase the cooling of the test chamber. The coils 10 and 12 operate in a conventional fashion for extracting heat from the test chamber so as to cool the chamber with the refrigerant in the coils 10 and 12 being vaporized during this heat extraction process.

The refrigerant is supplied to the evaporator coils 10 and 12 as a liquid by a distributor 22. The distributor 22 is connected to the evaporator coils 10 and 12 by lines 24 and 26 respectively. It can be seen that refrigerant flowing in the lines 24 and 26 from distributor 22 passes through the several passes of the tubes 14 and 16 in the evaporator coils 10 and 12 so as to extract the heat from the chamber with the fins 18 and 20 acting as a heat-exchange surface.

The primary expansion valve 28 upstream of the distributor 22 expands the fluid refrigerant so as to lower the pressure/temperature of the refrigerant supplied to the coils 10 and 12. The supply of cooled refrigerant to the coils 10 and 12 is controlled by the temperature and pressure at the outlet side of the test chamber which are detected by control lines 30 and 31 which are operatively connected to the expansion valve 28. Refrigerant flow to the expansion valve 28 is regulated by a solenoid valve 32 which meters the flow of refrigerant. In the open position, the solenoid valve 32 allows for the delivery of refrigerant to the coils 10 and 12, while in the closed position refrigerant flow is blocked, as will be described below. The solenoid valve 32 is in a closed position during low-demand periods at the test chamber, during which time the bypass circuit to be described below is operational. When the desired temperature in the chamber is reached, refrigerant flow to the coils 10 and 12 is metered by a metering circuit which includes a flow control 34 (shown as a capillary) and a solenoid valve 36. The solenoid valve 36 is cycled to deliver refrigerant to the coils as needed to maintain the temperature in the chamber. The liquid line 38 delivers liquid refrigerant to both solenoid valve 32 and 36. As is conventional in refrigeration systems of this type, the temperature of the air in the chamber is detected by a temperature sensor 29. A controller 33 is connected to the sensor 29 through a suitable control line and controls the operation of the solenoid valves 32 and 36 responsive to the temperature sensed by temperature sensor 29 in convention fashion through suitable control lines.

The outlet of the evaporator coils 10 and 12 is connected to a return line 40 which communicates the evaporated refrigerant to a first-stage compressor 42 which is part of the cascade refrigeration system and which is spaced some distance from the test chamber. The evaporated refrigerant in the return line 40 passes through a vibration eliminator 44 and a pump-down valve 46 before being delivered to the first-stage compressor 42 wherein the refrigerant is compressed for recycling in the system.

The first-stage compressor 42 delivers compressed refrigerant to an outlet 48 in which is disposed a pump-down valve 50, a vibration eliminator 52, a muffler 54 and oil separator 56. The oil separator 56 returns oil to the first-stage compressor 42 by way of a return line 58 with the oil flowing through a filter 60 before being delivered to the first-stage compressor 42.

The compressed refrigerant discharged by the oil separator 56 passes through a conduit 62 to a desuperheater or precooler 64. The desuperheater 64 is equipped with a drain 66 and a regulator valve 68. The supply of water to the desuperheater 64 is controlled by the valve 68 which is responsive to the temperature in a line 86 leading to a cascade condenser 88 by means of a control line 70. The desuperheater 64 provides for some cooling of the refrigerant before passing to the cascade condenser 88.

The system also includes a conventional vapor tank 72 which is equipped with conventional pump-down valves 74, 78 and a relief valve 76. When the pressure at the outlet side of the desuperheater 64 exceeds the desired pressure, which pressure regulates the amount of refrigerant delivered to the coils 10 and 12, the excess pressure is relieved into the vapor tank 72 through a dump valve 80. The dump valve 80 is controlled by the pressure in a line 82 which communicates with the inlet side of the desuperheater 64. The vapor tank 72 is connected to the evaporator coil return line 40 by means of a feed line 84.

The outlet of the desuperheater 64 is communicated by the line 86 to the cascade (first-stage) condenser 88. The line 86 includes a pump-down valve 90 through which refrigerant flows to the cascade condenser 88. The outlet of the cascade condenser communicates cooled refrigerant through an outlet line 92 to the coils 10, 12 through the above-described expansion devices. The refrigerant flowing through the line 86 passes into the cascade condenser 88 in a heat-exchange relationship with a second refrigerant as will be described below. The cooled refrigerant is then delivered to the expansion devices as described above for supply to the evaporator coils 10, 12. The refrigerant passes through a line 92 which connects with the line 38 for delivering liquid refrigerant to the expansion devices. The line 92 includes a drier 94 which acts as a filter to remove moisture, oil and dirt from the refrigerant.

The first-stage system can also include an injection cooling system wherein refrigerant in the line 38 is communicated to the first-stage compressor 42 by a line 96. Cooled refrigerant in the line 38 is diverted to the line 96 and to an expansion valve 98 for delivery to the intake of the first-stage compressor 42. The expansion valve 98 is controlled by the temperature in evaporator return line 40 which is communicated to the expansion valve 98 by a control line 100. The liquid-injection cooling minimizes compressor cycling so as to reduce power consumption and increase compressor life.

A bypass line 190, connected from line 38, which communicates liquid refrigerant to a heat exchanger 152 where liquid is changed to a gas and then communicated to a pressure reducing valve 180 is utilized to supply hot gas to the suction line 40. This is done during periods of low or no demand for cooling.

The refrigerant flowing to the cascade condenser 88 is cooled by a second-stage system which includes a second-stage compressor 102 having an outlet 104 which communicates compressed refrigerant through a line 110 to a second-stage condenser 112. The line 110 which communicates the compressor outlet 104 to the second-stage condenser 112 includes a pump-down valve 106, a vibration eliminator 108, a standard relief valve 114 and another pump-down valve 116. The second-stage condenser 112 is preferably water cooled and includes a drain 120 and a water-regulator valve 122. The regulator valve 122 controls the flow of water to the condenser 112, which regulator valve 122 is responsive to the pressure at the outlet of the second-stage compressor 112 and is connected thereto by a control line 124.

The cooled refrigerant exiting the condenser 112 passes to an outlet line 134 in which is disposed a pump-down valve 128, a drier 130 and a sight glass 132. The line 134 communicates the refrigerant to the cascade condenser 88. The cooled refrigerant passing through the conduit 134 is supplied to an expansion valve 138 and a distributor 140. Control of refrigerant flow through the line 134 is maintained by solenoid 136.

Operation of the expansion valve 138 is regulated by the temperature at the outlet side of the cascade condenser 88, which temperature is communicated to the expansion valve 138 by a control line 144. Operation of the expansion device 138 is further regulated by the pressure at the outlet side of the cascade condenser 88, which pressure is communicated to the expansion device by means of a control line 146. Refrigerant which is passed in a heat-exchange relationship with the refrigerant flowing in the first-stage system exits the cascade condenser 88 through a return line 148. The return line 148 includes a vibration eliminator 150 through which the refrigerant flows before recycling to the second-stage compressor 102.

The above-described cascade refrigeration system is conventional in an environmental test chamber. The system provides for delivery of a cooled refrigerant to the evaporator coils 10 and 12 so as to cool the test chamber. It has been found, however, that when locating an evaporator at a distance from the condensers, there is a problem with maintaining liquid refrigerant at the expansion devices. When low-temperature refrigerants are used, piping the cooled refrigerant to the expansion device allows the refrigerant to absorb energy from the surrounding environment which may cause the refrigerant to vaporize before it reaches the expansion valve. Accordingly, there was a need to insulate the liquid refrigerant line so as to avoid the vaporization problem. During full-load conditions, the refrigerant is delivered at a sufficient velocity so as to avoid this vaporization problem. During low-load conditions, the refrigerant flows at a slower rate and thus is susceptible to absorbing heat from the surrounding environment so as to cause vaporization. Thus, it is desirable to maintain a sufficient liquid flow to the expansion valve so as to avoid vaporization of the refrigerant under low-load conditions. Further, it is desirable to bypass the flow of refrigerant around the expansion device when no cooling is needed at the chamber.

In accordance with the invention, the refrigeration system includes a bypass circuit in the form of a bypass line 160 which diverts cooled refrigerant around the expansion devices to the outlet side of coils 10 and 12. The bypass line 160 communicates cooled refrigerant from line 38 to the return line 40 of the evaporator. Mounted in line 160 is a solenoid 162 which regulates operation of this bypass line 160. The line 160 also mounts a manual refrigeration valve 164 and an expansion device 166. Solenoid valves 158 and 162 are controlled by controller 33 through suitable control lines in reciprocal fashion to the control of the solenoid valves 32 and 36.

During operation at full load, the conventional two-stage cascade refrigeration system operates. During this time period, solenoid valves 158 and 162 are in a closed position, thus cutting off the bypass circuit. The system then operates as a conventional cascade refrigeration system. During low-load the conditions, the solenoid valves 32 and 36, which control the flow of refrigerant to the primary and secondary expansion devices, are closed since no cooling is needed in the coils 10 and 12. During this time, the solenoid valves 158 and 162 are open. With solenoid valve 162 open, refrigerant is drawn through bypass line 160, where refrigerant is expanded and cooled in expansion device 166 for return to the first-stage compressor. It can be seen that by diverting cooled refrigerant through line 160, a constant liquid flow is maintained around the evaporator coils 10 and 12. In this way, stagnation of a liquid in the fluid lines is avoided. Stagnation could lead to vaporization of the refrigerant due to absorption of heat from the surrounding environment. By maintaining a constant liquid presence at the expansion devices, no delay in cooling of the chamber will result when demand in the system increases. In prior systems, vaporization of the refrigerant in the line leading to the expansion devices would cause a delay in cooling of the chamber until such time that liquid refrigerant could be delivered through the line leading to the expansion devices.

The manual refrigeration valve 164 functions to provide a trickle or low flow of liquid through bypass line 160 when the solenoid valve 162 is open. The expansion device 166 functions to expand the liquid in bypass line 160 to a gas for comingling with the gas in return line 40. Thus, when the solenoid valve 32 is closed down and the solenoid valves 162 and 158 are open, the major portion of the liquid in line 82 will be bypassed through bypass line 190, thereby avoiding transport of the liquid through the long line 38 to the cooling chamber, and back again as in the prior art. Yet, liquid is maintained at the expansion device for cooling when needed. The flow of liquid through the long line 38 will be minimized due to the restricted flow through the bypass line 160.

Whereas the invention has been described with reference to the use of a solenoid valve 162 in the bypass line 160, the invention can also be carried out without such a valve so long as the bypass line has some form of restriction to control the flow rate and an expansion device for converting the liquid into a gas. In this case, thus, a small trickle of liquid would continuously flow through the bypass line 160.

It can be seen that the above-described refrigeration system provides a means for maintaining a constant liquid presence at the expansion devices leading to the evaporator. By maintaining a constant liquid flow through the refrigeration system, vaporization of the refrigerant is avoided, which vaporization restricts the responsiveness of the system to changes of temperature in the test chamber. The vaporization of the refrigerant causes a lag in cooling of the test chamber since it is necessary to purge the vaporized refrigerant from the refrigerant line when the chamber requires additional cooling. Systems in which such vaporization occurred cannot be controlled as accurately as the system described above wherein a constant liquid refrigerant is maintained in the system so that no delay in cooling of the test chamber occurs due to the presence of vapor in the refrigerant line.

The invention also provides for the bypass circuit without returning the liquid to the condensors with a separate conduit as was required in the prior art.

Reasonable variation and modifications are possible within the scope of the foregoing disclosure and drawing without departing from the spirit of the invention which is defined by the appended claims.

The embodiments of the invention in which an exclusive property or privilege is claimed are defined as follows:

1. A refrigeration system including a compressor and cooling system for supplying a refrigerant to an evaporator unit for cooling a chamber to a selected temperature, said evaporator unit being located adjacent said chamber and remote from said compressor and cooling system and including a heat-exchange surface;

supply conduit means for communicating said refrigerant from said compressor and cooling system to said evaporator unit, said supply conduit including first and second conduits connected in series, said second conduit being adjacent said chamber;

expansion valve means for providing a cooled and expanded refrigerant to said evaporator unit disposed in said second conduit and between said evaporator unit and said compressor and cooling system;

first control valve means in said second conduit for controlling the flow of refrigerant to said expansion valve means;

first control means for controlling said first control valve means responsive to the temperature in said chamber; and a return line for communicating spent refrigerant from said evaporator unit to said compressor and cooling system;

the improvement which comprises:

first bypass conduit means for diverting cooled refrigerant from said supply conduit line around said evaporator unit and to said return line, said first bypass conduit connected at one end to said first conduit means at said evaporator unit and at the other end thereof connected to said return line at said evaporator unit, said bypass conduit means including second control valve means for selectively diverting said refrigerant to said return line;

a second bypass line connected at one end to said first conduit at said compressor and cooling system and at the other end thereof connected to said return line at said compressor and cooling system to return refrigerant to said compressor and cooling system;

a third control valve means in said second bypass line to control the flow of refrigerant through said second bypass line;

said first control means simultaneously controlling said first, second and third valve means to open said second and third control valve means while closing said first control valve means and vice versa, in responsive to temperature changes in said chamber;

whereby said first bypass conduit and said second bypass conduit operate in response to low-demand conditions at said evaporator unit so as to provide a constant liquid refrigerant flow through said refrigeration system.

2. A refrigeration system according to claim 1 wherein said second bypass conduit includes means to heat exchange refrigerant in said second bypass conduit with liquid in said compressor and cooling system to heat said refrigerant.

3. A refrigeration system according to claim 2 wherein said first bypass conduit includes an expansion means for expanding the liquid passing therethrough.

4. A refrigeration system according to claim 3 wherein said first bypass conduit further includes a restrictive valve to control the flow of liquid therethrough.

5. A refrigeration system according to claim 1 wherein said first bypass conduit includes a restrictor valve for controlling the flow of liquid therethrough and an expansion valve means for expanding the liquid passing therethrough.

6. A refrigeration system including a compressor and cooling system for supplying a refrigerant to an evaporator unit for cooling a chamber to a selected temperature, said evaporator unit being located adjacent said chamber and remote from said compressor and cooling system and including a heat exchange surface;

supply conduit means for communicating said refrigerant from said compressor and cooling system to said evaporator unit, said supply conduit including first and second conduits connected in series, said second conduit being adjacent said chamber;

expansion valve means for providing a cooled and expanded refrigerant to said evaporator unit disposed in said second conduit and between said evaporator unit and said compressor and cooling system;

the first control valve means in said second conduit for controlling the flow of refrigerant to said expansion valve means;

first control means for controlling said first control valve responsive to the temperature in said chamber; and a return line for communicating spent refrigerant from said evaporator unit to said compressor and cooling system;

the improvement which comprises:

first bypass conduit means for diverting cooled refrigerant from said supply conduit line around said evaporator unit and to said return line, said first bypass conduit connected at one end to said first conduit means at said evaporator unit and at the other end thereof connected to said return line at said evaporator unit, said bypass conduit means including a means for restricting the flow of liquid therethrough and a means for expanding liquid therein to a gas;

a second bypass line connected at one end to said first conduit at said compressor and cooling system and at the other end thereof connected to said return line at said compressor and cooling system to return refrigerant to said compressor and cooling system;

second control valve means in said second bypass line to control the flow of refrigerant through said second bypass line, said first control means simultaneously controlling said first and second control valve means to open said said second control valve means while closing said first control valve means, and vice versa, in response to temperature changes in said chamber;

wherein said first and second bypass conduit means operate in response to low-demand conditions at said evaporator unit so as to provide a constant liquid refrigerant flow through said refrigeration system.

7. A refrigeration system according to claim 6 wherein said second bypass conduit includes means to heat exchange refrigerant in said second bypass conduit with liquid in said compressor and cooling system to heat said refrigerant.

8. A method for cooling a chamber to a selected temperature including the steps of:

cooling a refrigerant in a compressor and cooling system;

passing said cooled refrigerant from the compressor and cooling system to an expansion device disposed adjacent said chamber for cooling said chamber to a selected temperature;

expanding said cooled refrigerant in said expansion device so as to further cool said refrigerant; and returning spent refrigerant exiting said evaporator unit to said compressor and cooling system, the improvement which comprises:

selectively bypassing said cooled refrigerant around said expansion device to said return line at said expansion device during periods of low demand at said chamber so as to maintain a constant liquid flow to said system;

selectively bypassing said cooled refrigerant around said compressor and cooling system at said compressor and cooling system during periods of low demand at said chamber;

synchronizing the bypass of said cooled refrigerant around said expansion device and around said compressor and cooling system during periods of low demand at said chamber with the throttling of the flow of cooling refrigerant to said expansion device to maintain a constant liquid flow through said system, thereby avoiding vaporization of said refrigerant upstream of the expansion device during said low-demand period.

* * * * *